US008244171B2

(12) United States Patent
Ingrassia et al.

(10) Patent No.: US 8,244,171 B2
(45) Date of Patent: Aug. 14, 2012

(54) IDENTIFYING RADIO STATIONS OF INTEREST BASED ON PREFERENCE INFORMATION

(75) Inventors: Michael Ingrassia, San Jose, CA (US); Jeffery Lee, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 308 days.

(21) Appl. No.: 12/425,890

(22) Filed: Apr. 17, 2009

(65) Prior Publication Data

US 2010/0267331 A1 Oct. 21, 2010

(51) Int. Cl.
*H04H 60/09* (2008.01)

(52) U.S. Cl. ..... 455/3.04; 455/154.1; 455/179.1; 455/184.1; 455/185.1

(58) Field of Classification Search ..... 455/3.04, 455/151.1, 151.2, 154.1, 179.1, 184.1, 185.1, 455/186.1, 432.3
See application file for complete search history.

(56) References Cited

U.S. PATENT DOCUMENTS

| | | | | |
|---|---|---|---|---|
| 4,918,531 | A | 4/1990 | Johnson | |
| 6,952,576 | B2 * | 10/2005 | Fish et al. | 455/414.1 |
| 7,251,452 | B2 * | 7/2007 | Stumphauzer, II | 455/3.06 |
| 7,346,320 | B2 * | 3/2008 | Chumbley et al. | 455/186.1 |
| 7,409,205 | B2 | 8/2008 | Mittal | |
| 7,412,202 | B2 | 8/2008 | Gutta et al. | |
| 7,421,243 | B2 | 9/2008 | Sato et al. | |
| 7,587,185 | B2 * | 9/2009 | Nee | 455/186.1 |
| 7,647,419 | B2 | 1/2010 | Deshpande | |
| 7,653,342 | B2 | 1/2010 | Nichols et al. | |
| 7,676,203 | B2 * | 3/2010 | Chumbley et al. | 455/186.1 |
| 7,801,500 | B2 * | 9/2010 | Kraft et al. | 455/160.1 |
| 7,840,178 | B2 | 11/2010 | Hellman | |
| 2002/0194593 | A1 | 12/2002 | Tsuchida et al. | |
| 2003/0014767 | A1 * | 1/2003 | Stumphauzer, II | 725/131 |
| 2003/0026344 | A1 * | 2/2003 | Rindsberg et al. | 375/260 |
| 2003/0194977 | A1 * | 10/2003 | Videtich et al. | 455/186.1 |
| 2004/0260682 | A1 * | 12/2004 | Herley et al. | 707/3 |
| 2005/0153650 | A1 | 7/2005 | Hikomoto | |
| 2005/0193015 | A1 | 9/2005 | Logston et al. | |
| 2006/0058997 | A1 * | 3/2006 | Wood | 704/233 |
| 2007/0250597 | A1 | 10/2007 | Resner et al. | |
| 2007/0286169 | A1 | 12/2007 | Roman | |
| 2008/0077679 | A1 | 3/2008 | Bawany et al. | |
| 2008/0188209 | A1 | 8/2008 | Dorogusker et al. | |

(Continued)

OTHER PUBLICATIONS

IBM, "Predictive location based auto-tuning of radio systems," IPCOM000056563D, Feb. 14, 2005.

(Continued)

*Primary Examiner* — Lincoln Donovan
*Assistant Examiner* — William Hernandez
(74) *Attorney, Agent, or Firm* — Kramer Levin Naftalis & Frankel LLP

(57) ABSTRACT

Systems and methods are provided for providing recommended radio stations to a user. In particular, an electronic device can compare media from a locally stored or accessed media library with media items provided as part of radio streams received by the device. The electronic device can identify the radio streams having the most media items overlapping with the local library, and recommend those streams as being most likely to be of interest to the user. The electronic device can further access a remote database of a large number of users' libraries, and receive recommendations based on the media items common to the user's library, other users' libraries, and radio broadcasts. This approach allows the electronic device to provide recommendations without requiring any monitoring of the user's listening habits or receiving preference information from the user.

22 Claims, 6 Drawing Sheets

U.S. PATENT DOCUMENTS

| | | | | |
|---|---|---|---|---|
| 2008/0207137 | A1 | 8/2008 | Maharajh et al. | |
| 2008/0222546 | A1 | 9/2008 | Mudd et al. | |
| 2008/0256453 | A1 | 10/2008 | Fein et al. | |
| 2008/0268772 | A1* | 10/2008 | Linnamaki et al. | 455/3.04 |
| 2009/0023406 | A1 | 1/2009 | Ellis | |
| 2009/0298418 | A1 | 12/2009 | Michael et al. | |
| 2010/0010648 | A1 | 1/2010 | Bull et al. | |
| 2010/0106852 | A1 | 4/2010 | Kindig et al. | |
| 2010/0124892 | A1* | 5/2010 | Issa et al. | 455/179.1 |
| 2010/0255772 | A1 | 10/2010 | Hellman | |
| 2010/0268361 | A1 | 10/2010 | Mantel et al. | |

OTHER PUBLICATIONS

Live365.com, "Live365 Internet Radio," http://www.live365.com, printed on Apr. 17, 2009.

IBM, "Retrieving Information at a Later Time Related to What Was Being Broadcast at That Particular Time," IPCOM000139261D, Aug. 17, 2006.

Leydon, "Enhanced browsing and selection for media devices." IPCOM000131715D, Nov. 16, 2005.

* cited by examiner

IDENTIFYING RADIO STATIONS OF INTEREST BASED ON PREFERENCE INFORMATION

FIELD OF THE INVENTION

This relates to systems and methods for identifying radio stations of interest based on information received from a user's electronic device. In particular, this relates to systems and methods for identifying radio stations of interest based on specific media items in a media library stored on an electronic device of the user.

BACKGROUND OF THE INVENTION

Using a radio system, a user can receive radio waves broadcast from a radio station and provide an audio output associated with the received radio waves. An electronic device having communications circuitry appropriate for receiving broadcast radio waves can receive radio broadcasts from several sources. For example, several terrestrial radio stations can broadcast signals with sufficient strength to reach the user's electronic device. As another example, satellite radio stations can broadcast signals over large geographic regions. As still another example, Internet radio stations can provide broadcast signals that may be received by any device having an Internet connection. Each radio station can broadcast any suitable media, such as music or talk shows. In particular, different radio stations can broadcast media of a particular type, such as music stations broadcasting music from a particular era, of a particular genre, or by a specific artist (e.g., the U2 station on satellite radio).

Because of the large number of radio stations available to a user, some radio devices can recommend specific radio stations as being of interest to a user. To determine the user's preferences, the radio devices can ask the user a series of questions to identify the user's interests (e.g., direct the user to rank genres or identify particular artists or songs of interest), monitor attributes of the radio stations and media items to which a user listens, or receive from a second source metadata describing attributes of particular media items to which a user listens. While these approaches can be used to provide radio station recommendations, they require the user to either affirmatively provide recommendations, or a history of prior media consumed by the user.

SUMMARY OF THE INVENTION

Systems and methods are provided for identifying radio stations of interest to a user. Using an electronic device with appropriate communications circuitry, a user can receive broadcasts from one or more media sources. Each media source can provide an audio stream that can be played back by the electronic device when tuning to the media source. The particular audio provided in each stream can vary from media source to media source. For example, some media sources can provide music streams, other media sources can provide talk programs, and still other media sources can provide combinations of the two or other types of audio. Within each audio type, different radio stations can broadcast different categories or genres of media. For example, different music radio stations can broadcast music from different eras, of different genres, by specific artists, or from specific locations. As another example, different talk radio stations can broadcast sports talk, news talk, business talk, or politics talk.

Because each radio station may broadcast different types of audio, a user may be interested in only a subset of the available radio stations. For example, the user may be interested in only recent musical hits and sports talk radio. To provide appropriate recommendations to a user, an electronic device can retrieve information describing the user's interests. In particular, the electronic device can compare the media items stored locally on the user's electronic device or available from a host device to which the electronic device can connect with the media broadcast by each radio station. The electronic device can then identify the radio stations providing the most matches, and recommend those radio stations.

In some embodiments, the electronic device can treat each radio station as a distinct media library, where the different media items played back by the radio station define the radio station media library. The electronic device can in addition monitor play counts to determine which media items are of more importance to or more representative of the radio station media stream. By then comparing radio station media libraries with the user's own media library, and adjusting as necessary based on play counts and user ratings, the electronic device can identify and recommend particular radio stations to the user.

BRIEF DESCRIPTION OF THE FIGURES

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Using an electronic device with communications circuitry, a user can tune to and receive broadcast streams provided by media or content sources. For example, a user can direct an electronic device radio tuner to tune to a particular radio station. Because a large number of content providers may be available to a user, the electronic device can provide recommendations to the user. In particular, the electronic device can compare media locally stored on the electronic device or on a host device from which the electronic device receives the media with the particular media items of each broadcast stream receivable by the electronic device. Upon identifying the broadcast streams having the most overlapping content with the locally stored media, the electronic device can recommend the content sources or radio stations providing the identified broadcast streams. As used in this application, the term media item will be understood to include any audio or video that can be broadcast by a content source and received by an electronic device for playback. For example, a media item can include music (e.g., a song), a talk show segment, an advertisement, news programming, a podcast, videos, or any other media content that may be provided to a user. In addition, it will be understood that embodiments described in the context of a radio broadcast by a radio station can also be provided using any type of media broadcast by any media or content source over any suitable communications network.

Figure 1:
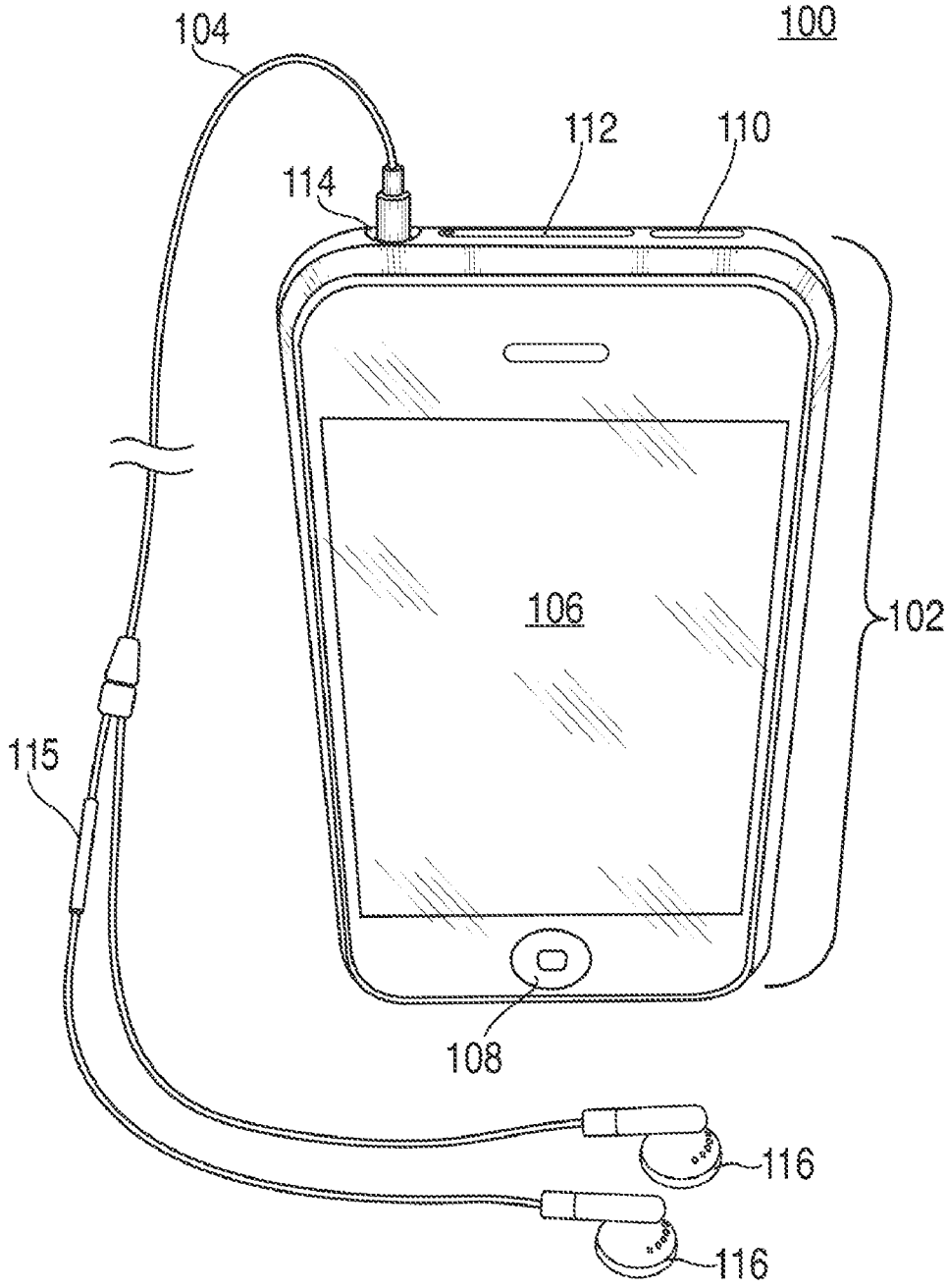
FIG. 1 is an illustrative electronic device in accordance with some embodiments of the present invention.

FIG. 1 is illustrative user device 100 that is in accordance with some embodiments of the present invention. User device 100 may generally be any device that can receive radio stations. For example, in some embodiments, user device 100 can internally have a radio tuner. In other embodiments, user device 100 can have the necessary ports to be coupled to an external radio tuner. User device 100 can then receive radio signals through the external radio tuner. For example, user device 100 can be a handheld radio, a car radio, a cellular phone, a personal data assistant (PDA), a handheld digital music player such as an iPod™ (available from Apple Inc. of Cupertino, Calif.), or a laptop or notebook computer. Although user device 100 is generally depicted as a handheld device in FIG. 1, user device 100 can also be a non-handheld device such as a desktop computer.

User device 100 can include main device 102 and one or more accessory devices 104. Generally, any of the components of user device 100 described below can be integrated into main device 102, contained in accessory device 104, or both. For example, as discussed above, a radio tuner can be integrated into accessory device 104 or integrated directly inside main device 102. Additionally, although accessory device 104 is depicted as being physically coupled to main device 102 in FIG. 1, accessory device 104 may alternatively be wirelessly coupled to main device 102.

In some embodiments, user device 100 can include display screen 106. Further to the discussion above, display screen 106 does not need to be integrated into main device 102, and in other embodiments can be an accessory device that is physically or wirelessly coupled to main device 102. Display screen 106 can include any suitable screen, such as a television screen, a computer monitor, a projection screen, a liquid crystal display (LCD) screen, or an organic light-emitting diode (OLED) screen. Display screen 106 can present various types of information to the user such as graphical and/or textual displays. This can include, for example, user-selectable options, radio station playlists, music playlists, stored videos, stored photos, stored data, and system information. In some embodiments, display screen 106 can function as a user input mechanism that allows for a touch screen or user input via a touch input (e.g., from actual or near contact of a user's finger or of a tool with the screen).

User device 100 can also include one or more of user input mechanisms 108 and 110. These mechanisms can be, for example, a keyboard, buttons, switches, track wheels, or click wheels. User device 100 can include one or more of port 112 for coupling external data and/or hard drives into user device 100. For example, port 112 can enable user device 100 to receive SIM cards, flash drives, or external hard drives. There can be multiple ways of connecting accessory devices through, for example, connector 114. Persons skilled in the art will appreciate that connector 114 can be any suitable connector such as one or more USB ports, 30-pin connector ports, dock or expansion ports, and headset jacks.

User device 100 can also include user input/output devices such as microphone 115 and speakers 116. Although depicted as being contained in accessory device 104, one skilled in the art would appreciate that microphone 115 and speakers 116 may alternatively or additionally be contained in main device 102.

Figure 2:
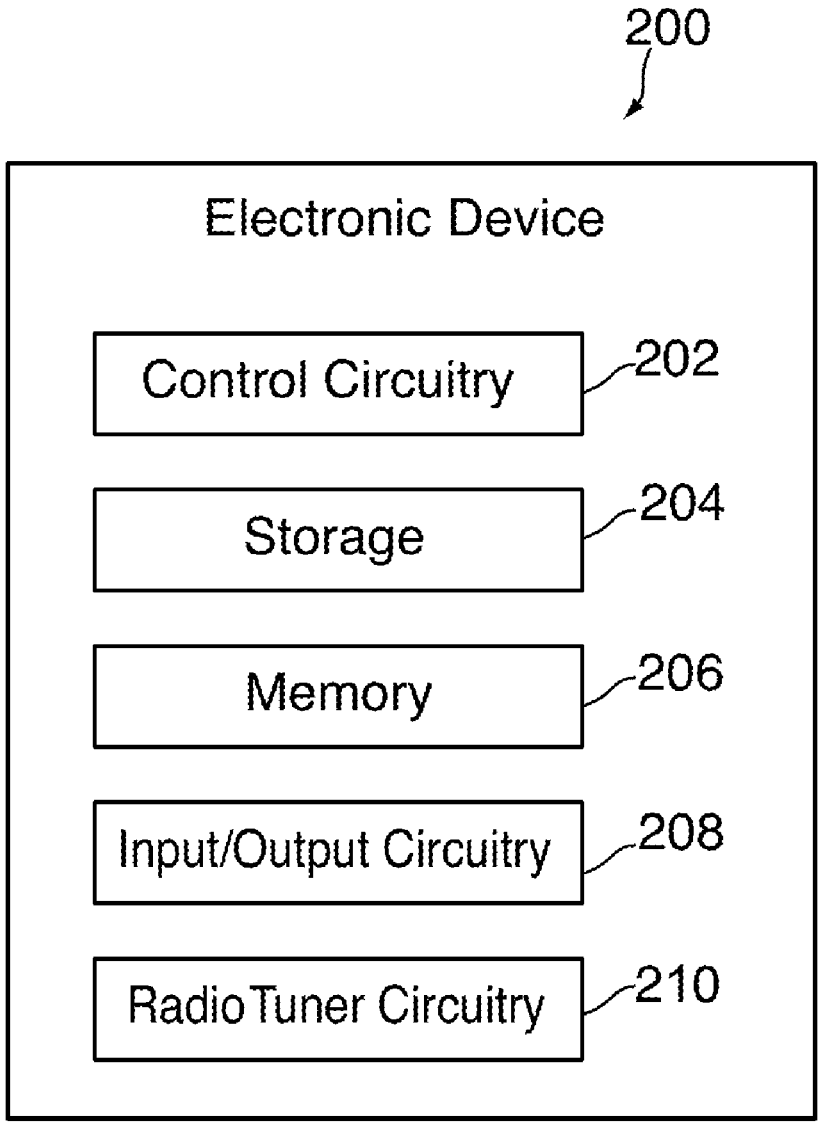
FIG. 2 is a schematic view of an illustrative electronic device in accordance with some embodiments of the present invention.

FIG. 2 is a schematic view of an illustrative electronic device in accordance with some embodiments of the invention. For example, electronic device 200 can correspond to user device 100 of FIG. 1. Electronic device 200 can include control circuitry 202, storage 204, memory 206, input/output circuitry 208, and radio tuner circuitry 210. In some embodiments, one or more of components of electronic device 200 can be combined or omitted (e.g., combine storage 204 and memory 206). In some embodiments, electronic device 200 can include other components not combined or included in those shown in FIG. 2 (e.g., motion detection components, a power supply such as a battery, or a bus), or several instances of the components shown in FIG. 2. For the sake of simplicity, only one of each of the components is shown in FIG. 2.

Control circuitry 202 can include any processing circuitry or processor operative to control the operations and performance of electronic device 200. For example, control circuitry 202 can be used to run operating system applications, firmware applications, media playback applications, radio tuner applications, or any other application. In some embodiments, the control circuitry can drive a display and process inputs received from a user interface.

Storage 204 can include, for example, one or more storage mediums including a hard-drive, solid state drive, flash memory, permanent memory such as ROM, any other suitable type of storage component, or any combination thereof. Storage 204 can store, for example, media data (e.g., music and video files), application data (e.g., for implementing functions on device 200), firmware, user preference information data (e.g., radio preset preferences), authentication information (e.g. libraries of data associated with authorized users), wireless connection information data (e.g., information that can enable electronic device 200 to establish a wireless connection), and any other suitable data or any combination thereof.

Memory 206 can include cache memory, semi-permanent memory such as RAM, and/or one or more different types of memory used for temporarily storing data. In some embodiments, memory 206 can also be used for storing data used to operate electronic device applications, or any other type of data that can be stored in storage 204. In some embodiments, memory 206 and storage 204 can be combined as a single storage medium.

Input/output circuitry 208 can be operative to convert (and encode/decode, if necessary) analog signals and other signals into digital data. In some embodiments, input/output circuitry 208 can also convert digital data into any other type of signal, and vice-versa. Although input/output circuitry 208 is illustrated in FIG. 2 as a single component of electronic device 200, several instances of input/output circuitry can be included in electronic device 200.

Radio tuner circuitry 210 can include any suitable circuitry for tuning to a particular frequency of a received radio signal. For example, by resonating at a particular frequency, radio tuner circuitry 210 can pass that particular frequency and exclude any other frequencies that were received with the radio signal. Radio tuner circuitry can communicate with input/output circuitry 208 to audibly output the particular frequency through, for example, speakers 116 of FIG. 1. In some embodiments, the electronic device can instead or in addition include communications circuitry operative to connect to other types of content sources using different types of communications networks, such as communications circuitry for connecting to satellite radio stations, Internet radio stations, dedicated broadcast sources (e.g., on-demand content sources), or any other suitable content source. For the sake of brevity, it will be understood that any suitable content source and any communications network can be used instead of or in addition to a radio station and a radio network in the following discussion.

In some embodiments, electronic device 200 can include a bus operative to provide a data transfer path for transferring data to, from, or between control processor 202, storage 204, memory 206, input/output circuitry 208, radio tuner circuitry 210, and any other component included in the electronic device.

Figure 3:
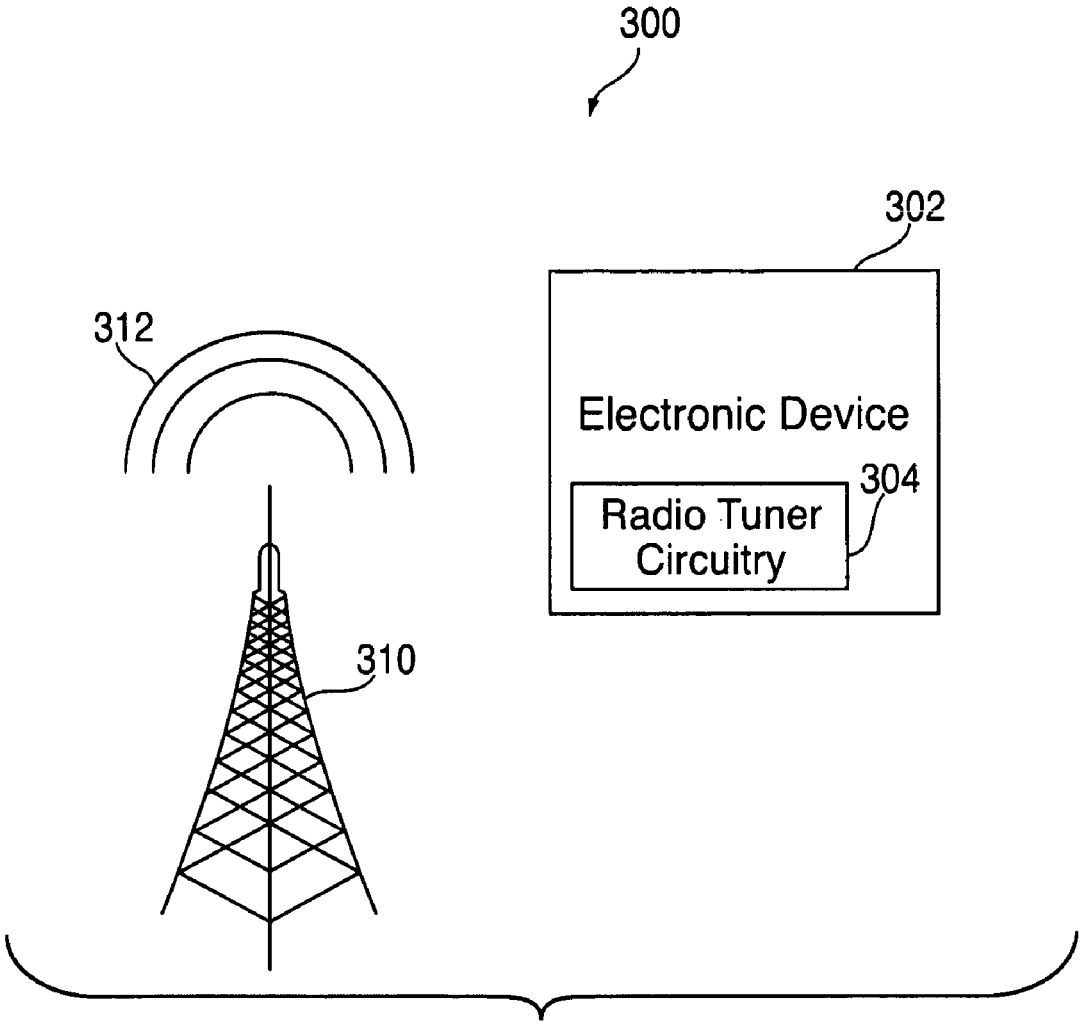
FIG. 3 is a schematic view of an illustrative system for providing and receiving radio broadcasts in accordance with one embodiment of the invention.

FIG. 3 is a schematic view of an illustrative system for providing and receiving radio broadcasts in accordance with one embodiment of the invention. System 300 can include one or more electronic devices 302 operative to receive radio station broadcasts, although only one is shown in FIG. 3 for simplicity. Each electronic device 302 can include radio tuner circuitry 304 operative to tune to and receive a radio broadcast. Radio station 310 can provide broadcast 312 of media using, for example, a AM or FM radio signal, for any electronic device 302 within the broadcast range of radio station 310. In addition to the media, radio station 310 can broadcast radio station information such as Radio Data System (RDS) information. RDS information can include, for example, digital information such as station identification, the current song's track, artist, genre, and length information, and/or alternative frequencies for particular stations.

To determine which radio stations or broadcast content sources will be of interest to a user, the electronic device can first identify the particular media available from each radio station. The electronic device can identify the particular broadcast media using any suitable approach. For example, the electronic device can monitor each radio station and store data describing each broadcast media item (e.g., identified from an analysis of the broadcast audio, or from metadata broadcast with the media, such as RDS, RT or RT+ data). As another example, the electronic device can access a remote database that includes a listing of the media items broadcast by particular radio stations. The remote database can include past and present broadcast media content, as well as future media content (if available). The remote database can be provided by individual radio stations, or generated and managed by a specialized entity. As still another example, the electronic device can identify media items provided by a radio station from alternative sources of the radio broadcast, such as a counterpart Internet radio station of a terrestrial or Internet radio station. The electronic device can monitor the alternative source, or alternatively retrieve listings of broadcast media items from the alternative source (e.g., retrieve from the past ten songs broadcast from a radio station website, or determine future guests on a talk show program from a website schedule).

The electronic device can locally store the media items broadcast by each radio station. Alternatively, the electronic device can retrieve the listing of broadcast media items from a host device or server operative to store such information. In some embodiments, the electronic device can provide the listing of broadcast media items to the host device or server, or alternatively the host device or server can, instead or in addition to the electronic device, identify and store the listings of media items broadcast by each radio station (e.g., using any of the approaches described above in connection with the electronic device).

To determine which media would be of interest to a particular user, the electronic device can catalog the media items locally stored or locally available to the user of the electronic device. For example, the electronic device can identify, from metadata associated with each media item, the available media items stored in memory or stored on a host device from which the electronic device receives media (e.g., a computer to which a portable media device is coupled). In some embodiments, the electronic device can provide the catalogued information to a remote server that receives and processes information defining the media libraries of several electronic devices. Using an algorithm for determining the relative proximity of two or more media items, the electronic device, the remote server, or both can mathematically define a proximity value for each of the media items in the one or more libraries processed by the electronic device, remote server, or both.

The algorithm can use any suitable attribute of the media items within the libraries to determine the proximity value. For example, the algorithm can consider metadata attributes of the media items (e.g., artist and genre). As another example, the algorithm can process media items based on the libraries in which they were found. In particular, the algorithm can identify, for each media item in a particular library, the other media items within the same library. The algorithm can in addition process user-generated playlists that include a subset of media items from a library. Because single users typically listen to media having some similarity within a single playlist, or own media items that can be categorized in one or more groupings, the algorithm can predict the similarity of media items without processing the attributes of the media items (e.g., define similarity without verifying that the defined genre is the same). When the electronic device or remote server processes a large number of playlists and libraries provided by a large number of users or distinct electronic devices, the electronic device or remote server can identify overlaps in libraries and playlists, and thus determine which sets of media items are most related.

Once the electronic device has identified the media of most interest to the user, the electronic device can compare the identified media with the media items provided by the radio stations. In particular, the electronic device can treat the listings of media items broadcast by each radio station as the library of media items for the radio station. Each radio station library can be provided to the electronic device or remote server processing the similarity between media items to determine the relative similarity of each of the radio station libraries with the library of the electronic device. In some embodiments, the electronic device can directly compare each radio station library with the locally accessed media library to identify the overlapping media items, artists, genres, or other metadata categories. The electronic device can then recommend the radio stations for which the corresponding radio station libraries had the most overlap with the media library of the electronic device.

Figure 4:
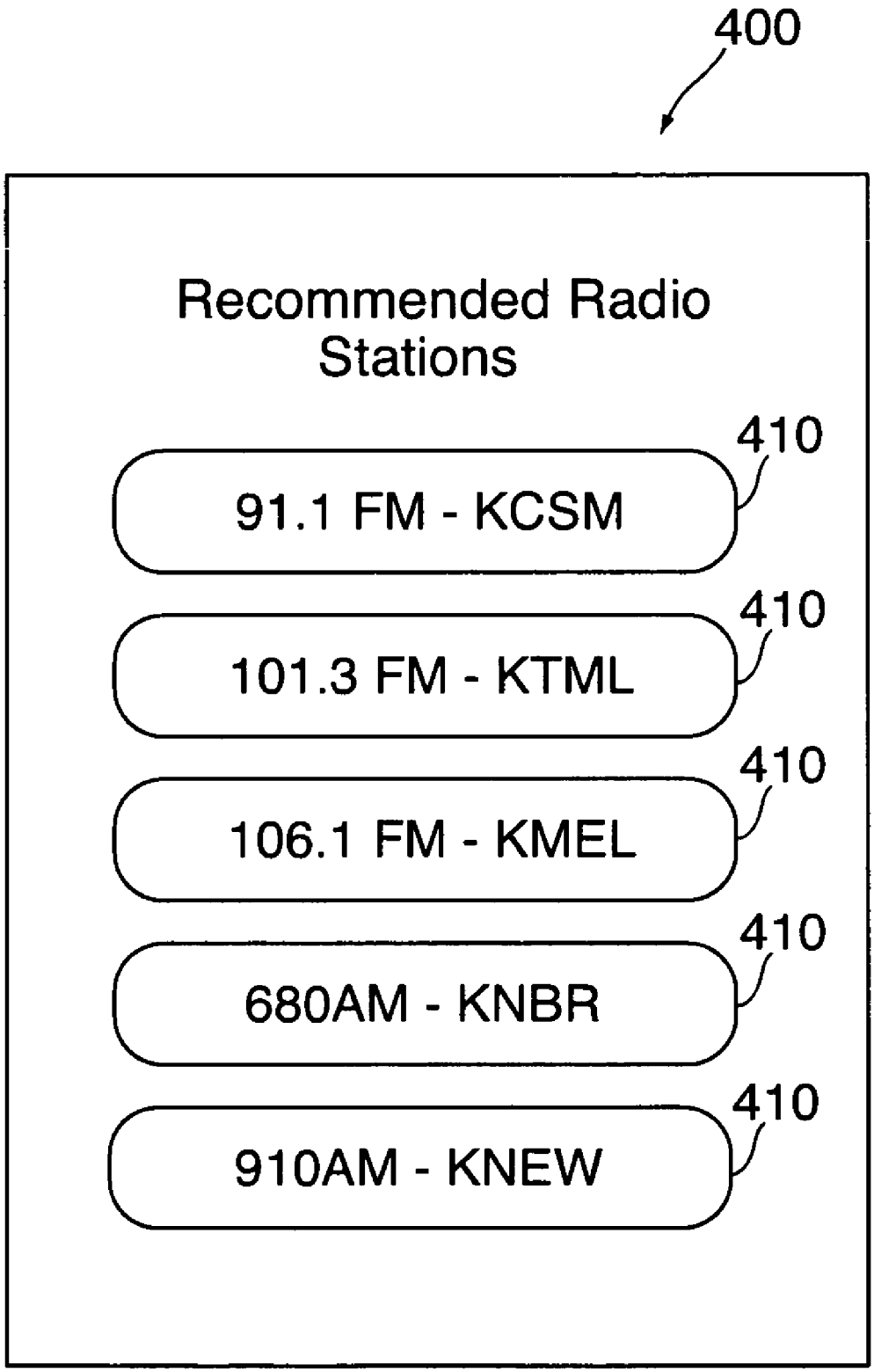
FIG. 4 is a schematic view of an illustrative display for recommending radio stations in accordance with one embodiment of the invention.

The electronic device can provide the recommended radio stations to the user using any suitable approach. In some embodiments, the electronic device can store the identified radio stations as presets mapped to a particular input interface, such as physical buttons (e.g., in an automobile or accessory). As another example, the electronic device can provide a menu or display with selectable recommended radio stations. FIG. 4 is a schematic view of an illustrative display for recommending radio stations in accordance with one embodiment of the invention. Display 400 can include options 410 of recommended radio stations that the user can select. In response to receiving a user selection of an option 410, the electronic device can tune to the appropriate frequency and play back the broadcast received from the radio station. The electronic device can provide any suitable information in each option 410, including for example the radio station frequency, call sign, type or genre, broadcast location, website, current media item or segment, next media item or segment, or any other suitable information related to the radio station that would be of interest to the user. In some embodiments, the electronic device can provide further information related to a radio station instead of or in addition to tuning to a radio station in response to receiving a user selection of an option 410. The electronic device can display options 410 in any suitable order, including for example based on the radio frequency, alphabetically by call sign, how related each radio station library is to the user's media library (e.g., most relevant first), or any other suitable order.

In some embodiments, the electronic device can determine that no individual media items, artists, or both of the user's media library match corresponding media items, artists or both of radio station libraries. This may in particular be the case for talk radio programs, for which a user may not necessarily have corresponding media items in the user's media library (e.g., the user can instead subscribe to podcasts for talk programs by hosts similar to those available from the radio broadcasts). To provide recommendations to the user, the electronic device can retrieve, from an appropriate source of proximity information (e.g., a remote server), information describing the proximity of the media items of the user's media library with the media items of each radio station library. In some embodiments, the electronic device can instead or in addition identify other media libraries having both particular media items from the user's media library and from a radio station library. In particular, the electronic device can identify groupings, clusters or "buckets" of media items that are commonly found in libraries or playlists (e.g., buckets of related media items). Using the buckets, the electronic device can identify the radio station libraries that have the most media items in buckets of the media items of the user's media library, and recommend the identified radio stations. In some embodiments, the electronic device can define buckets based only on several playlists defined for the local media library (e.g., if information from other electronic devices is not available).

To ensure that the electronic device properly recommends radio stations based on the media items of the user's library, the electronic device can weigh each of the buckets differently. For example, each bucket weight can be incremented for each media item of the user's library that is in a bucket. As another example, buckets can be weighed based on the play counts of different media items, or based on any other suitable factor reflecting the user's media library. Correspondingly, the radio station libraries can be more or less attributed to buckets based on the number of media items in the radio station library, on the play counts of each media item (e.g., if a song is repeated often by a radio station, the radio station is more closely attributed to the bucket corresponding to the song), or on any other suitable factor reflecting the media items in the radio station library.

In some embodiments the electronic device can modify the recommended radio stations based on the time of day or day of the week at which a user requests the present listing. For example, the electronic device can determine that a user listens to a particular playlist or a particular subset of the user's media library at specific times (e.g., music on weekday mornings, news podcasts on weekday evenings, and sports radio on the weekend). The electronic device can then recommend radio stations that match the particular media items of the user's media library that are consumed at the corresponding time of day. For example, the electronic device can identify the particular buckets associated with the media played back at each identified part of the day, and retrieve radio stations associated with each of the identified presets for each day part. The electronic device can monitor the user's local media playback using any suitable approach, including for example, storing metadata indicative of playback timing.

In some embodiments, the electronic device can identify available radio stations or other media broadcasts, and tailor broadcast recommendations based on the availability of the broadcasts. For example, the electronic device can recommend broadcasts for which the strength of the received signal exceeds a minimum threshold. As another example, the electronic device can recommend broadcasts for which static or other transmission artifacts are below a pre-determined threshold.

Figure 5:
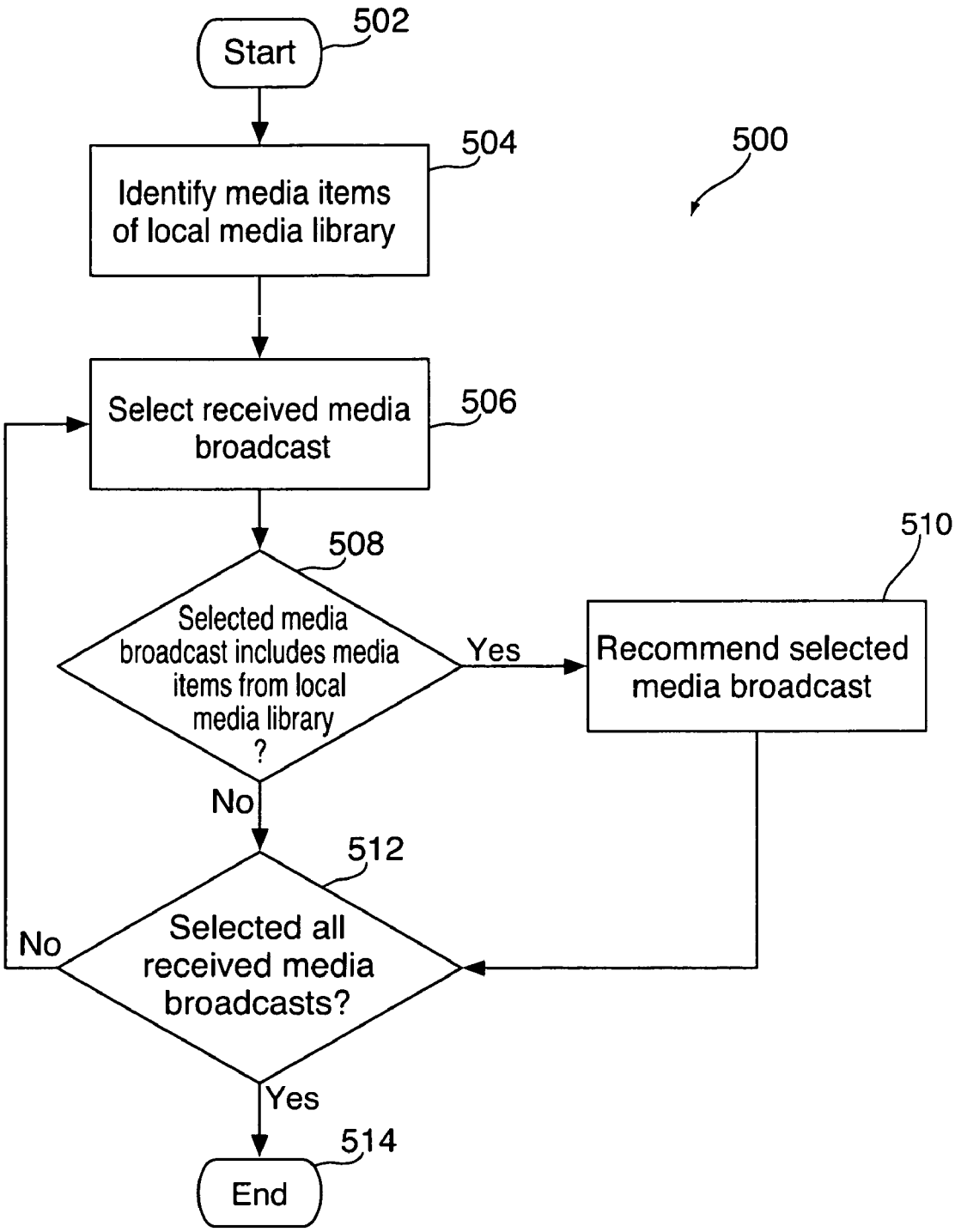
FIG. 5 is a flowchart of an illustrative process for identifying recommended radio stations in accordance with one embodiment of the invention.

The following flowcharts describe illustrative processes for use in identifying radio stations of interest. FIG. 5 is a flowchart of an illustrative process for identifying recommended radio stations in accordance with one embodiment of the invention. Process 500 can begin at step 502. At step 504, the electronic device can identify media items from a locally accessed media library. For example, the electronic device can identify media items stored on the electronic device, or available from a host device to which the electronic device connects. At step 506, the electronic device can select a received media broadcast. For example, the electronic device can select a radio broadcast received by tuning radio tuning circuitry to a frequency at which a radio station transmits.

At step 508, the electronic device can determine whether the selected media broadcast includes media items identified from the local media library. For example, the electronic device can determine whether an identified media item was broadcast as part of the radio station broadcast. The electronic device can identify the content of a radio broadcast of each radio station using any suitable approach, including for example from RDS, RT or RT+data broadcast with the media, a distinct source of radio data, or any other suitable approach. If the electronic device determines that some of the media items provided as part of the selected media broadcast match identified media items from the user's local library, process 500 can move to step 510. At step 510, the electronic device can recommend the selected media broadcast. For example, the electronic device can store information for receiving the selected media broadcast, provide selectable options for the selected media broadcast, map the selected media broadcast to an electronic device input interface (e.g., map the broadcast to a preset button), or any other suitable approach. In some embodiments, the electronic device can assign a rank or priority to the selected media broadcast based on the number of media items that matched the local media library (e.g., to only recommend the highest ranking broadcasts). Process 500 can then move to step 512.

If, at step 508, the electronic device instead determines that the selected media broadcast does not include media items identified from the local media library, process 500 can move to step 512. At step 512, the electronic device can determine whether all of the received media broadcasts have been selected. For example, the electronic device can determine whether the device has directed tuning circuitry to tune to each possible frequency. As another example, the electronic device can determine whether media broadcasts have been selected from all available communications networks (e.g., AM, FM and satellite). As still another example, the electronic device can determine whether media broadcasts from all content sources known in a library have been selected (e.g., all content sources for known Internet radio stations). If the electronic device determines that all received media broadcasts have not been selected, process 500 can return to step 506 and select an unselected media broadcast. If the electronic device instead determines that all received media broadcasts have been selected, process 500 can move to step 514 and end.

Figure 6:
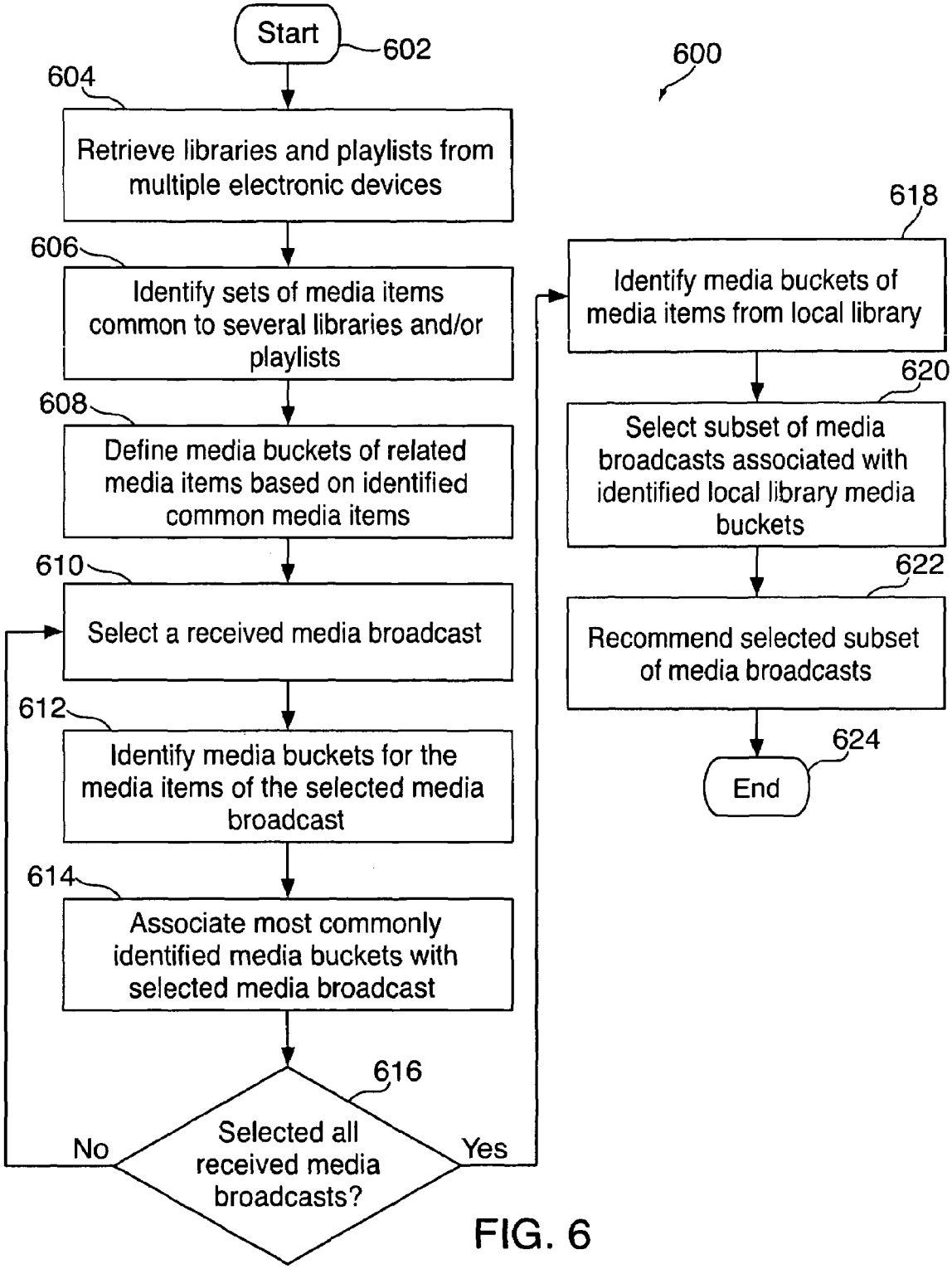
FIG. 6 is a flowchart of an illustrative process for recommending media streams using buckets of related media in accordance with one embodiment of the invention.

FIG. 6 is a flowchart of an illustrative process for recommending media streams using buckets of related media in accordance with one embodiment of the invention. Process 600 can begin at step 602. At step 604, the electronic device can retrieve libraries and playlists from multiple electronic devices. For example, several electronic devices can send a listing of media items in individual libraries, playlists, or both to the electronic device or to a remote server for processing. Although the following discussion will be described in the context of an electronic device, it will be understood that a remote server can perform the described steps. As another example, the electronic device can process several playlists generated for the local media library. At step 606, the electronic device can identify sets of media items common to several libraries, playlists, or both received at step 604. For example, the electronic device can identify particular media items that appear together in different collections of media. In some embodiments, the electronic device can apply exclusion rules (e.g., based on genre) to ensure that obviously unrelated media items are not combined in a set.

At step 608, the electronic device can define media buckets or clusters of related media items based on identified common media items. For example, the electronic device can identify sets of media items that include a sufficiently large number of items (e.g., at least a predetermined number of items) and define those sets as buckets. The electronic device can define any suitable number of buckets, including for example buckets that have overlapping media items (e.g. a bucket with 80s music can overlap with a bucket for American Pop music).

At step 610, the electronic device can select a received media broadcast. For example, the electronic device can select a radio broadcast received by tuning radio tuning circuitry to a frequency at which a radio station transmits. At step 612, the electronic device can identify media buckets for the media items of the selected media broadcast. The electronic device can identify the media items of a radio broadcast of each radio station using any suitable approach, including for example from RDS, RT or RT+data broadcast with the media, a distinct source of radio data, or any other suitable approach. The electronic device can then match the identified media items with the defined media buckets. At step 614, the electronic device can associate the selected media broadcast with the media buckets most commonly identified at step 612. For example, the electronic device can increment a counter for each identified media bucket, and select the media buckets having the largest counter values. The electronic device can identify each media broadcast with any suitable number of media buckets, including for example a fixed number, a number selected based on the values of the media bucket counters (e.g., at least 100 songs in a particular media bucket), a number selected based on the percentage value of each media bucket counter (e.g., associate with all media buckets having at least 30% of the broadcast media items), or any other suitable number of media buckets.

At step 616, the electronic device can determine whether all of the received media broadcasts have been selected. For example, the electronic device can determine whether the device has directed tuning circuitry to tune to each possible frequency. As another example, the electronic device can determine whether media broadcasts have been selected from all available communications networks (e.g., AM, FM and satellite). As still another example, the electronic device can determine whether media broadcasts from all content sources known in a library have been selected (e.g., all content sources for known Internet radio stations). If the electronic device determines that all received media broadcasts have not been selected, process 600 can return to step 610 and select an unselected media broadcast. If the electronic device instead determines that all received media broadcasts have been selected, process 600 can move to step 618.

At step 618, the electronic device can identify media buckets for the media items of the local media library associated with the electronic device. For example, the electronic device can identify the media buckets having at least a minimum number of media items in a particular media bucket. In some embodiments, the electronic device can identify and select only the media buckets having a minimum number of local media items (e.g., to ensure that the identified media buckets are relevant to the user's local media library). In some embodiments, the identified and selected media buckets can change based on the time of day or day of the week. At step 620, the electronic device can select a subset of the media broadcasts associated with the identified local library media buckets. For example, the electronic device can select a subset of media broadcasts that are related to the most common media buckets of the electronic device local library. As another example, the electronic device can select media broadcasts that are more strongly associated with identified media buckets (e.g., instead of a media broadcast less strongly associated with a media bucket closer related to the local media library).

At step 622, the electronic device can recommend the selected subset of media broadcasts. For example, the electronic device can store information for receiving the selected subset of media broadcasts, provide selectable options for the media broadcasts, map the media broadcasts to an electronic device input interface, or any other suitable approach. In some embodiments, the electronic device can assign a rank or priority to the media broadcasts based on the number of media items that matched the local media library (e.g., to only recommend the highest ranking broadcasts). Process 600 can then end at step 624.

The above described embodiments of the present invention are presented for purposes of illustration and not of limitation, and the present invention is limited only by the claims which follow.

What is claimed is:

1. A method for providing radio station recommendations for an electronic device, comprising:

identifying media items in a library of the electronic device;

determining media items broadcast by each of a plurality of radio stations available to radio tuning circuitry of the electronic device;

detecting the radio station broadcasting the most determined media items matching identified specific media items in the library;

recommending the detected radio station;

determining a number of the determined media items matching identified media items for each of the plurality of radio stations;

selecting a subset of the plurality of radio stations having the largest determined number; and recommending the selected subset of the plurality of radio stations.

2. The method of claim 1, wherein recommending further comprises:

mapping the detected radio station to a selectable preset button of the electronic device.

3. The method of claim 1, further comprising:

monitoring the media items broadcast by a plurality of radio stations using the radio tuning circuitry of the electronic device; and identifying from the monitoring, for each of the plurality of radio stations, the media items broadcast by the radio station.

4. The method of claim 1, further comprising:

receiving a listing of media items broadcast by a plurality of radio stations from a remote source; and identifying from receiving, for each of the plurality of radio stations, the media items broadcast by the radio station.

5. The method of claim 4, wherein receiving further comprises receiving a listing comprising media items to be broadcast in the future.

6. The method of claim 1, further comprising:

assigning a priority to each radio station of the selected subset based on the determined number for each radio station; and recommending each radio station of the selected subset based on the assigned priority.

7. A method for providing radio station recommendations for an electronic device, comprising:

identifying media items in a library of the electronic device;

determining media items broadcast by each of a plurality of radio stations available to radio tuning circuitry of the electronic device;

detecting the radio station broadcasting the most determined media items matching identified specific media items in the library;

recommending the detected radio station;

identifying the strength of signal for each of the plurality of radio stations; and detecting the radio station broadcasting the most determined media items for which the identified strength of signal exceeds a minimum threshold.

8. A system for providing radio station recommendations to a user of an electronic device, comprising:

a server in communication with a plurality of electronic devices, the server comprising communications circuitry, memory and a processor, the processor operative to:

direct the communications circuitry to receive, from the plurality of electronic devices, listings of media items available in libraries of the plurality of electronic devices;

identify sets of media items common to several of the libraries;

group each identified set of media items in a cluster;

direct the communications circuitry to identify, from a plurality of media sources, media items broadcast by the media sources;

determine, for each of the plurality of media sources, the clusters associated with the broadcast media items; and recommend, to each of the plurality of electronic devices, the particular media sources broadcasting media items from clusters associated with media items of the electronic device library.

9. The system of claim 8, wherein:

the server further comprises radio tuning circuitry operative to tune to at least one of the plurality of media sources; and the processor is further operative to:

direct the radio tuning circuitry to tune to at least one of the plurality of media sources; and monitor the media items broadcast by the at least one of the plurality of media sources.

10. The system of claim 8, wherein:

a media source recommended to a particular electronic device has no broadcast media items in common with the media items of the particular electronic device library.

11. The system of claim 8, wherein the processor is further operative to:

identify a primary cluster associated with each of the plurality of media sources;

rank, for each electronic device, the clusters associated with the media items of the electronic device library; and recommend media sources based on the ranked position of the primary cluster of the media sources for each electronic device.

12. The system of claim 11, wherein the processor is further operative to:

identify secondary clusters associated with each of the plurality of media sources; and recommend media sources based on the ranked position of secondary clusters of the media sources when media sources have the same primary cluster.

13. The system of claim 8, wherein the processor is further operative to:

direct the communications circuitry to receive, from the plurality of electronic devices, listings of media items combined in user-generated playlists;

identify sets of media items common to several of the user-generated playlists; and group each identified set of media items in a cluster.

14. The system of claim 8, wherein the processor is further operative to:

identify the strength of signal for broadcasts of each of the plurality of media sources; and detect the particular media sources broadcasting media items from clusters associated with media items of the electronic device library for which the identified strength of signal exceeds a minimum threshold.

15. An electronic device operative to receive media broadcasts, comprising communications circuitry, memory, and a processor, the processor operative to:

identify buckets of media items associated with media items stored in the memory, wherein each bucket includes a listing of media items common to a plurality of electronic device libraries;

retrieve a listing of media items broadcast by each of a plurality of media sources received by the communications circuitry;

determine the buckets associated with the broadcast media items of each of the plurality of media sources;

identify a subset of the plurality of media sources for which the determined buckets match the identified buckets of the electronic device library; and recommend the identified subset of the plurality of media sources.

16. The electronic device of claim 15, wherein the processor is further operative to:

provide a listing of the media items in the electronic device library to a remote server, wherein a plurality of electronic devices provide listings of the media items in each of the plurality of electronic device libraries to the remote server; and receive, from the remote server, listings of media items in each of the identified buckets.

17. The electronic device of claim 16, wherein the processor is further operative to:

compare the retrieved listings of media items broadcast by each of the plurality of media sources with the received listings of media items in each of the identified buckets; and recommend a media source having more than a minimum threshold of media items within at least one of the identified buckets.

18. The electronic device of claim 15, wherein the processor is further operative to:

provide the retrieved listing of media items broadcast by each of the plurality of media sources to a remote server, wherein a plurality of electronic devices provide listings of the media items in each of the plurality of electronic device libraries to the remote server; and receive, from the remote server, the buckets associated with the media items broadcast by each of the plurality of media sources.

19. The electronic device of claim 18, wherein the processor is further operative to:

compare the identified buckets with the received buckets; and recommend media sources associated with received buckets that match identified buckets.

20. The electronic device of claim 15, wherein the processor is further operative to:

establish the bucket from which media items are played back at a particular time in the day;

identify a time-specific subset of the plurality of media sources for which the determined buckets match the established bucket; and recommend the identified time-specific subset of the plurality of media sources when the current time is the particular time of day.

21. A non-transitory computer readable media for providing radio station recommendations for an electronic device, the non-transitory computer readable media comprising computer readable instructions recorded thereon for:

identifying media items in a library of the electronic device;

determining media items broadcast by each of a plurality of available radio stations;

detecting the radio station broadcasting the most determined media items matching identified specific media items in the library;

recommending the detected radio station;

tuning radio tuning circuitry to the recommended radio station;

determining a number of the determined media items matching identified media items for each of the plurality of radio stations;

selecting a subset of the plurality of radio stations having the largest determined number; and recommending the selected subset of the plurality of radio stations.

22. The non-transitory computer readable media of claim 21, further comprising additional computer readable instructions recorded thereon for:

assigning a priority to each radio station of the selected subset based on the determined number for each radio station; and recommending each radio station of the selected subset based on the assigned priority.

* * * * *